United States Patent [19]

Shimada et al.

[11] Patent Number: 4,716,878

[45] Date of Patent: Jan. 5, 1988

[54] DEVICE FOR MOUNTING A CARBURETOR HAVING A BODY MADE OF SYNTHETIC RESIN

[75] Inventors: Mithuo Shimada, Tokyo; Yoetsu Yokocho, Ome; Yoshiki Nakayama, Akishima, all of Japan

[73] Assignee: Kioritz Corporation, Tokyo, Japan

[21] Appl. No.: 851,796

[22] Filed: Apr. 14, 1986

[30] Foreign Application Priority Data

May 2, 1985 [JP] Japan ..... 60-65192[U]
May 14, 1985 [JP] Japan ..... 60-70099[U]

[51] Int. Cl.[4] ..... F02M 31/20

[52] U.S. Cl. ..... 123/540; 123/41.31; 123/52 M; 261/DIG. 81

[58] Field of Search ..... 123/41.31, 540–542, 123/543, 545, 547, 52 M; 261/DIG. 81

[56] References Cited

U.S. PATENT DOCUMENTS

| | | | |
|---|---|---|---|
| 1,953,809 | 4/1934 | Kenneweg | 123/541 X |
| 2,072,862 | 3/1937 | Balfe | 123/543 X |
| 2,085,574 | 6/1937 | Chandler | 123/547 X |
| 2,397,392 | 3/1946 | Weber | 123/540 X |
| 3,332,476 | 7/1967 | McDougal | 123/540 X |
| 3,509,860 | 5/1970 | Ferriday | 123/545 |

*Primary Examiner*—Tony M. Argenbright
*Attorney, Agent, or Firm*—Browdy and Neimark

[57] ABSTRACT

The device for mounting a carburetor having a body made of synthetic resin comprises a heat insulating member for intercepting transmission of heat from a cylinder of an engine to the carburetor and a temperature adjusting metallic member is interposed between the heat insulating member and the carburetor.

2 Claims, 2 Drawing Figures

DEVICE FOR MOUNTING A CARBURETOR HAVING A BODY MADE OF SYNTHETIC RESIN

BACKGROUND OF THE INVENTION

1. Field of the Invention

The present invention relates to a device for mounting a carburetor having a body made of synthetic resin and, more particularly, to a heat insulating structure thereof.

2. Description of the Prior Art

Recently, a carburetor having a body made of synthetic resin comes into wide use for the purpose of reducing the weight and size and lowering the manufacturing cost. Such a carburetor having a body made of synthetic resin has a tendency that it is difficult to be heated in comparison with the carburetor having a body made of metal (diecast by aluminum), while it is difficult to be cooled, thereby resulting in various drawbacks such as vapor lock phenomenon due to the residual heat at the re-starting of the engine. Therefore, in order to maintain a proper temperature of the carburetor to avoid the above described drawbacks, it is necessary to arrange the carburetor at a position spaced apart from a cylinder of the engine to which the carburetor is connected and which acts as a heat source. In the case of a carburetor which is directly mounted on the suction port of a cylinder of the engine with a heat insulating member interposed therebetween, it is necessary to use a thick heat insulating member, thereby causing a drawback that the length of the mounting portion of the carburetor is rendered to be long.

SUMMARY OF THE INVENTION

It is an object of the present invention to avoid the above described drawbacks of the prior art carburetor and to provide a device for mounting a carburetor having a body made of synthetic resin wherein the length of the mounting portion of the carburetor is shortened, and the present invention is characterized by the provision of a metallic member such as made of aluminum alloy having a superior heat radiating property interposed between the heat insulating member and the carburetor having a body made of synthetic resin.

Other object of the present invention is to provide a carburetor having a receptacle for the carburetor having a great heat radiating effect.

BRIEF DESCRIPTION OF THE DRAWINGS

The accompanying drawings illustrate embodiments of the device for mounting a carburetor having a body made of synthetic resin according to the present invention.

DESCRIPTION OF THE PREFERRED EMBODIMENTS

Figure 1:
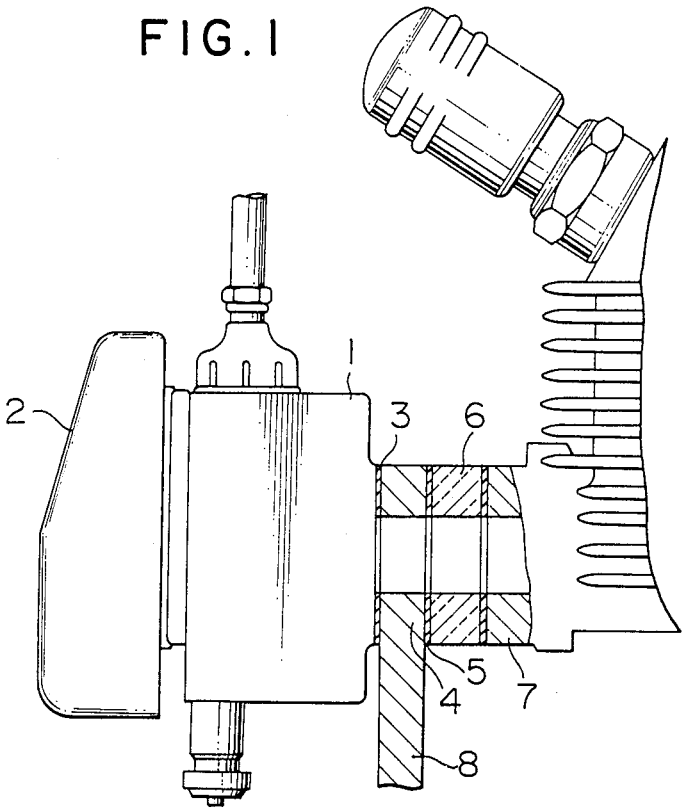
FIG. 1 is a side view partly in section showing the main parts of an embodiment of the device for mounting the carburetor of the present invention.

The present invention will be described below with reference to embodiments shown in the drawings. In FIG. 1, a carburetor 1 having a body made of synthetic resin is for use in a compact type engine, and an air cleaner 2 is fixedly secured to the suction side of the carburetor 1 at the left side thereof, the air cleaner 2 communicating with the carburetor 1. The fuel-air mixture discharge side of the carburetor 1 communicates with a suction port 7 of a cylinder of an engine through a packing 3, a temperature adjusting metallic member 4, another packing 5 and a relatively thin heat insulating member 6. The packings 3, 5 serve also as sealing means, while they act to further reduce the heat transmission toward the carburetor 1. The temperature adjusting metallic member 4 is preferably made of a metal such as aluminum alloy having a high heat radiating effect, and it may be formed with heat radiating fins on the outer surface thereof in like manner as in the case of the cylinder, thereby enhancing the cooling effect by the latent heat of vaporization of gasoline. It is further preferred to provide an extension 8 on the temperature adjusting metallic member 4 for permitting the radiant heat to be intercepted. The thickness of the heat insulating member 6 is determined on the basis of the temperature of the cylinder and the heat radiating effect of the temperature adjusting metallic member 4, and it can be made considerably thinner in comparison with the case in which only a heat insulating member is used.

Thus, the temperature adjusting metallic member 4 is provided for the purpose of enhacing the heat radiating effect in order to further enhance the effectiveness of the heat insulating member 6, thereby permitting the length of the mounting portion of the device for mounting the carburetor 1 serving to communicate it with the cylinder to be made short, while the heat transmission toward the carburetor 1 can further be reduced by the interposition of the packings 3, 5 at both sides of the metallic member 4.

Figure 2:
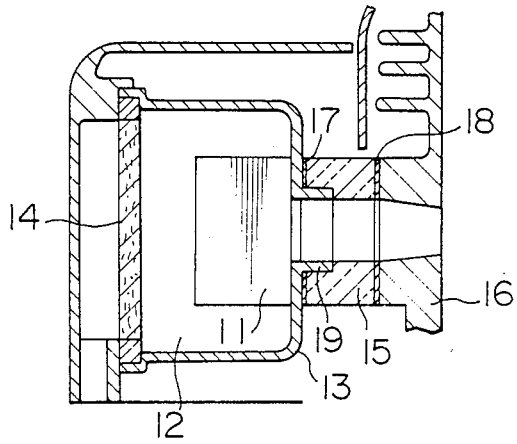
FIG. 2 is a vertical cross-sectional view showing the main parts of another embodiment.

FIG. 2 shows another embodiment, and a carburetor 11 having a body made of synthetic resin is for use in a compact type engine, and the carburetor 11 is fixedly secured within a receptacle 12 for the carburetor 11. The receptacle 12 housing therein the carburetor 11 is constructed by a metallic case 13 such as made of a thin steel plate having a superior heat radiating property in comparison with a synthetic resin and an air fitter 14 is provided at one side of the metallic case 13. The metallic case 13 is connected at the other side to a suction port 16 of a cylinder through packings 17, 18 and a heat insulating member 15 to communicate the fuel-air mixture discharge port of the carburetor 11 with the suction port 16. In order to enhance the cooling effect by the latent heat of evaporation of gasoline, an extended portion 19 of the metallic case 13 extends in a fuel-air mixture passage of the heat insulating member 15 so that the heat radiating effect can be further enhanced by increasing the length of the extended portion 19.

As described above, since the heat radiating effect is enhanced by utilizing the metallic case 13 forming the receptacle 12 for the carburetor 11, the thickness of the heat insulating member 15 connecting the carburetor 11 to the cylinder can be made considerably thinner, thereby permitting the device for mounting the carburetor to be made compact and light weight, while the temperature of the carburetor 11 having the body made of synthetic resin is maintained within a proper range.

Further, even if the metallic case 13 forming the receptacle 12 for the carburetor 11 is used without providing any particular cooling member for the radiation of the heat, over-heating of the carburetor 11 can be effectively avoided without increasing the number of the components coupled with the heat insulating effect by the heat insulating member.

We claim:

1. Device for mounting a carburetor having a body made of synthetic resin having a heat insulating member for intercepting heat transmission from a cylinder of an engine to said carburetor, characterized by a temperature adjusting metallic member interposed between said heat insulating member and said carburetor, and in the said metallic member is constructed as a metallic case forming a receptacle for said carburetor.

2. Device according to claim 1, characterized in that a portion of said case extends in a fuel-air mixture passage of said heat insulating member.

* * * * *